US005716137A

United States Patent [19]

Meyer

[11] Patent Number: 5,716,137

[45] Date of Patent: Feb. 10, 1998

[54] BAG MADE OF THERMOPLASTIC FOIL

[75] Inventor: Armin Meyer, Köln, Germany

[73] Assignee: Lemo Maschinenbau GmbH, Niederkassel-Mondorf, Germany

[21] Appl. No.: 612,939

[22] PCT Filed: Aug. 26, 1995

[86] PCT No.: PCT/EP95/03381

§ 371 Date: Mar. 5, 1996

§ 102(e) Date: Mar. 5, 1996

[87] PCT Pub. No.: WO96/07590

PCT Pub. Date: Mar. 14, 1996

[30] Foreign Application Priority Data

Sep. 8, 1994 [DE] Germany ..... 44 31 977.0
Sep. 21, 1994 [DE] Germany ..... 44 33 582.2

[51] Int. Cl.[6] ..... B65D 33/28

[52] U.S. Cl. ..... 383/75; 383/10; 383/109; 493/225

[58] Field of Search ..... 383/75, 109, 10, 383/72; 493/225

[56] References Cited

U.S. PATENT DOCUMENTS

| | | | |
|---|---|---|---|
| 2,799,611 | 7/1957 | Dreisbach | 383/75 |
| 3,592,379 | 7/1971 | Nakamura | 383/75 X |
| 3,772,968 | 11/1973 | Ruda . | |
| 4,547,237 | 10/1985 | Hendrickson | 383/75 X |
| 4,813,792 | 3/1989 | Belmont et al. . | |
| 4,878,764 | 11/1989 | Meyer | 383/75 X |
| 5,161,895 | 11/1992 | Myers | 383/75 X |

FOREIGN PATENT DOCUMENTS

| | | | |
|---|---|---|---|
| 02 92 608 | 11/1988 | European Pat. Off. . | |
| 0 317 047 | 5/1989 | European Pat. Off. . | |
| 2 082 080 | 12/1971 | France . | |
| 2 129 275 | 10/1972 | France . | |
| 19 95 949 | 11/1968 | Germany . | |
| 19 24 030 | 11/1970 | Germany . | |
| 2215612 | 10/1973 | Germany | 383/75 |
| 38 21 905 | 2/1990 | Germany . | |
| 354 800 | 8/1981 | United Kingdom . | |
| 2 100 182 | 12/1982 | United Kingdom . | |

*Primary Examiner*—Jes F. Pascua
*Attorney, Agent, or Firm*—Herbert Dubno; Andrew Wilford

[57] ABSTRACT

The invention relates to a bag of thermoplastic resin foil and a method of making such a bag provided with a draw strip (3) and a hand hole (8) and in order to provide a relatively high carrying capacity the front wall (1) and the back wall (2) of the bag are each formed by an outer and an inner foil layer (1', 2') and furthermore the draw strip (3) is provided between these foil layers and is joined by side weld seams (5) with the bag.

10 Claims, 2 Drawing Sheets

FIG.1
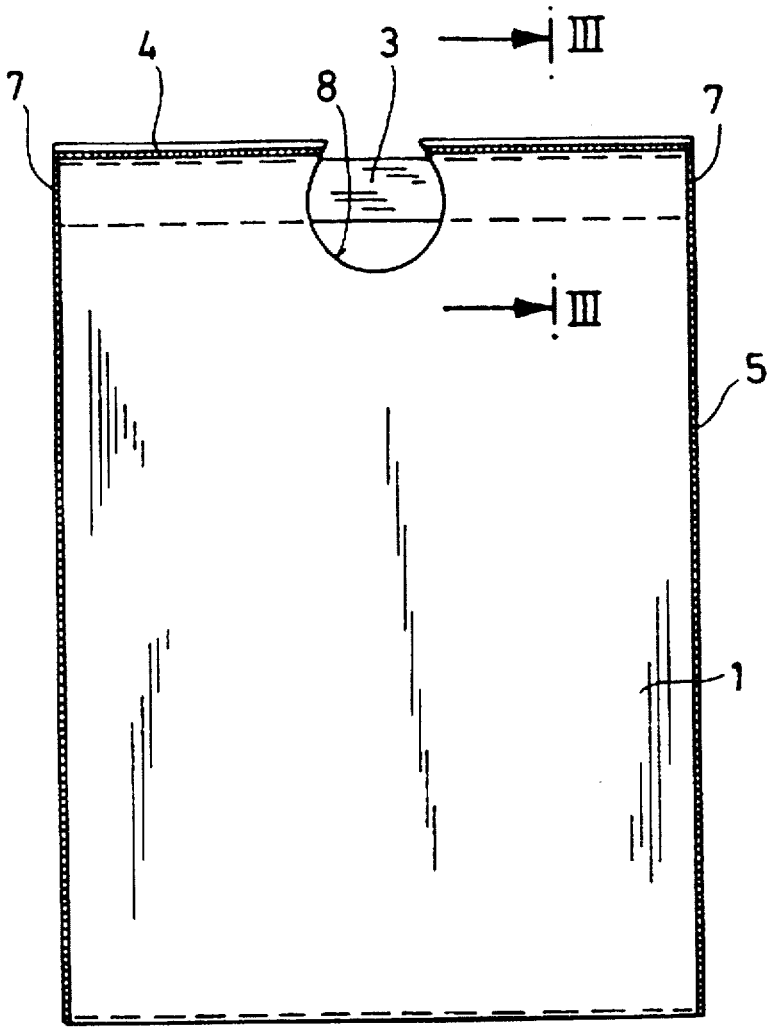
FIG.2
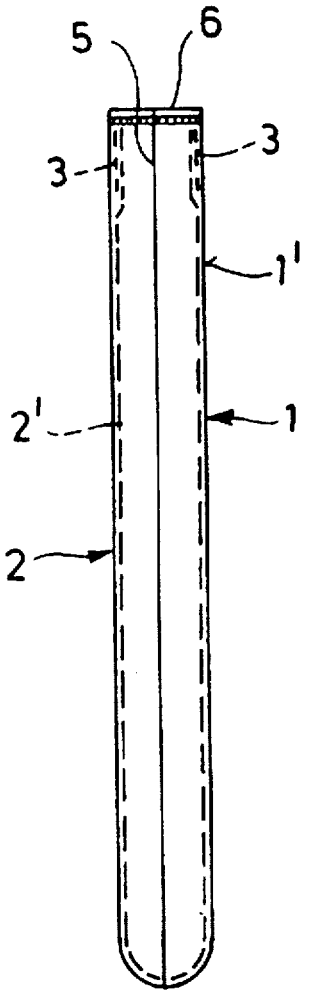
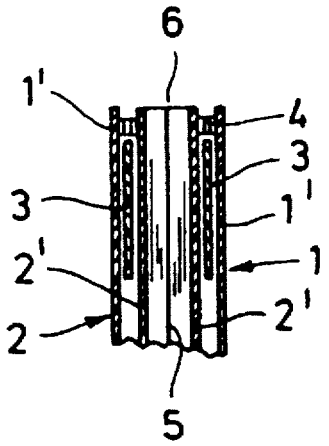
FIG.3

FIG. 4
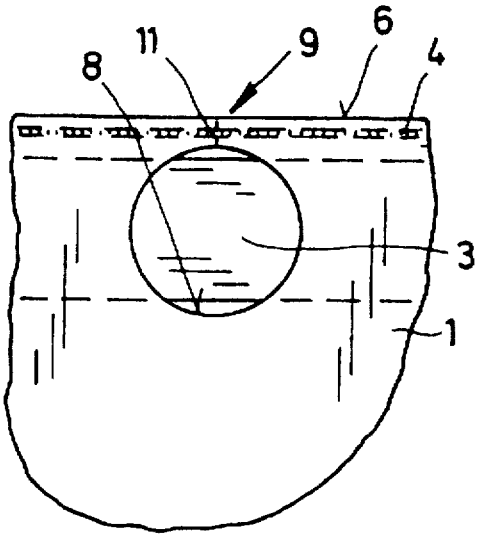
FIG. 5
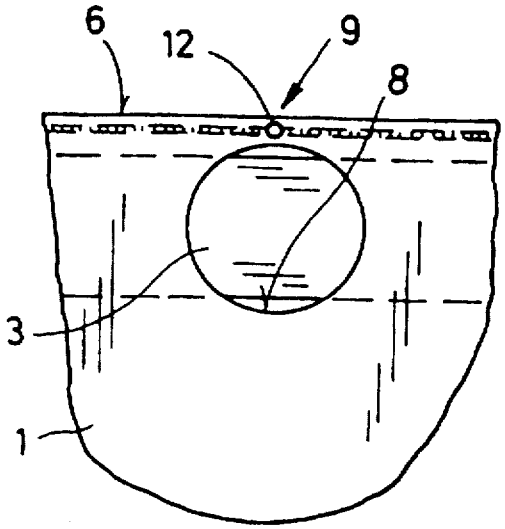
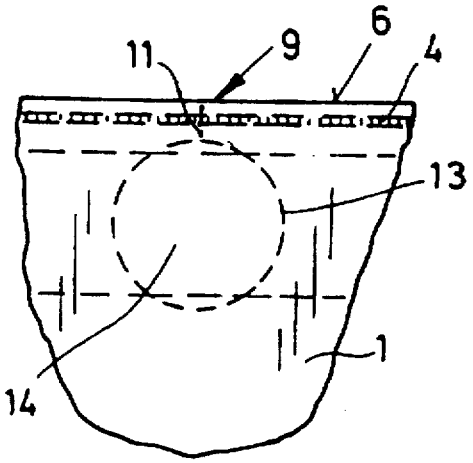
FIG. 6

BAG MADE OF THERMOPLASTIC FOIL

CROSS REFERENCE TO RELATED APPLICATIONS

This application is the US national phase of PCT application PCT/EP95/03381 filed 26 Aug. 1995 with a claim to the priorities of German application P 44 31 977.0 Filed 8 Sep. 1994 and P 44 33 582.2 filed 21 Sep. 1994.

FIELD OF THE INVENTION

The invention relates to a bag of a thermoplastic synthetic-resin foil with front and back walls connected at side weld seams, a fill opening extending over the entire width of the bag, adjacent thereto a draw strip connecting the side weld seams with the bag, an well as a hand hole partially exposing the draw strip.

BACKGROUND OF THE INVENTION

A bag of the described type is known in many different types. Thus for example German patent 3.821.905 describes a method of making bags with draw strips of thermoplastic resin foil where a draw strip is set into a welded seam formed by a folded-over edge at the fill opening and the seams are joined together with side weld seams. A hand hole in the middle of the seams allows one to grab the strip and carry the bag. With these standard bags the welding of the free end of the folded-over portion on the single-ply front wall and back wall of the bag forms a thin spot which is loaded when the bag is completely filled. The draw strip fixed on the bag is only secondarily held by the side weld seams. According to what is in the bag or its weight these standard bags are easily torn at the region of this thin spot so that this type of bag can only be used it is to be filled with light materials or the foil material and foil thickness are correspondingly selected for heavier contents.

OBJECT OF THE INVENTION

It an object of the invention to provide a bag of plastic foil a draw strip which in spite of relatively thin foil thickness is quite strong. In addition the bag should be able to be fully manufactured at a high production speed.

SUMMARY OF THE INVENTION

The objects of the invention are attained by a bag wherein the wall and the back wall are each formed by a respective inner and outer foil layer and a draw strip is provided between the foil layers of the front wall and back wall.

Such a bag can better stand being heavily loaded by its contents since the load of the contents is effective at first on the side seams in the region of the welded-in draw strip. In addition rials are economized since the otherwise necessary folded over seam need not be provided on the bag opening and in addition the can be thinner since as a result of how the load is carried foil layers together, not just the foil thickness of one layer, ed not correspond the wall thickness of a standard one-ply bag.

For best load-carrying capacity, the foil layers of the front wall and of the back wall are joined together in the outer-lying edge of the fill opening each by a longitudinal weld seam.

With the bag made according to the invention as described above the inner and outer foil layers are not only thinner than with the standard bags, but they can be specially selected according to the intended contents, that is for example formed of different plastics and/or of different thicknesses. Thus the usability of the bag according to the invention is substantially increased.

For simplification reasons the draw strip formed of a plastic foil is the same material as the inner or outer foil layer of the front wall and/or of the back wall.

Even the position and formation of the hand hole for partially exposing the draw strip plays a substantial role for the bag according to the invention. According to a preferred embodiment of the invention the hand hole situated in the region of the draw strip is formed narrower in the region of the fill opening than in the region of the draw strip. Thus the application of force to the draw strip or on the bag walls in the region of the fill opening is improved.

This is particularly the case when the hand hole is formed by a generally circular cutout whose center lies generally at the half height or width of the draw strip and whose opening takes up less than 180° of the region of the fill opening. The material points formed in this manner in the region of the fill opening prevent tearing of the front and back walls joined together at the longitudinal weld seam.

In an alternative embodiment the hand hole is spaced from the fill opening and the spacing web between the fill opening and the closest edge of the hand hole is provided with a perforation. The arrangement of the hand hole at a spacing from the edge of the fill opening not only makes a stronger bag, but facilitates its production since the longitudinal weld seam near the fill opening can be formed better.

In a further embodiment the hand hole itself is formed by a perforated line and the thus produced hole cover is usable directly as a support for a value symbol or similar tag. The application of value symbols or other tags is significant for disposal or recycling, in particular to show what fees have been paid.

A bag formed according to the invention of thermoplastic resin foil can be made particularly simply and efficiently in particular when starting from two flat plastic webs preferably pulled from supply rolls these are laid over each other and folded like a U and the hand hole is punched in the thus produced open top region and a draw strip preferably of plastic is inserted between each of the inner and outer layers and then the web layers are welded together as pairs in the head region whereupon the side weld seams and if necessary a perforation for making the individual bags is added.

BRIEF DESCRIPTION OF THE DRAWING

A preferred embodiment of the invention is shown in the drawing and is more closely described in the following. Therein:

FIG. 1 is a view of a finished bag;

FIG. 2 is a side view of the bag;

FIG. 3 is a section along line III—III of FIG. 4; and

FIGS. 4 through 6 are partial side views of different embodiments of a bag in the region of the hand hole in enlarged scale.

SPECIFIC DESCRIPTION

FIG. 1 show a bag of thermoplastic resin foil whose front wall 1 and back wall 2 respectively have an inner foil layer 1' and an outer foil layer 2' and the foil layers 1' and 2' each according to application of the bag can be made of different synthetic resins and/or can have if necessary different thicknesses. Inserted in the region of an upper fill opening 6 between the foil layers connected together by a longitudinal weld seam 4 is a draw strip 3 made of plastic that is also welded solidly with the bag by weld seams 5 during construction of the bag. In the central region of the draw strip 3 there is a hand hole 8 in the bag through which in order to close the bag the draw strip 3 can be pulled out and knotted.

As visible from FIG. 1 the hand hole is formed by a generally circular cutout whose center is generally in the center or the middle of the height of the draw strip 3 and whose opening in the region of the longitudinal seam 4 takes up less than 180°. It has been shown to be optimal when the radius of the hand hole 8 corresponds generally to the width or height of the draw strip 3.

The draw strip can be formed preferably of the same material as either the inner or the outer foil layer of the front wall 1 and/or back wall 2.

Variations on the hand hole 3 are shown in FIGS. 4 through 6. In all embodiments the circular hand hole is spaced from the edge of the fill opening and the separating web is perforated. While in FIGS. 4 and 6 the perforation 9 is a perforated line 11, on the contrary in FIG. 5 the perforation is a hole 12.

To use the bag the draw strips 3 are grabbed through the hand hole 8, the perforation 9 is torn, and the draw strips are knotted together if necessary.

In the embodiment according to FIG. 6 the hand hole itself is delimited by a perforation 13 so as to form a limited hole cover 14. This must be pushed out to use the bag, e.g. with the thumbs, in order to grab the draw strip 3. The hole cover 14 can either be a separable value symbol or identification element or a support for a stick-on value symbol or identification element. On use of the bag the separable value symbol can be stuck anywhere on the bag in order to show that for example particular fees have been paid or the bag has been bought through the proper channels. The arrangement of the value symbol in the region of the hand hole also has the advantage that when the bags are rolled up as is standard to a bag roll the value symbols are surely protected against being stolen.

A particularly advantageous method of making a bag of thermoplastic resin with a draw strip and hand hole is that starting from two flat plastic webs preferably pulled from supply rolls these are laid over each other and folded like a U and the hand hole is punched in the thus produced open top region and between each of the inner and outer layers a draw strip 3 preferably of plastic is inserted and then the web layers are welded together as pairs in the head region whereupon the side weld seams 5 and if necessary a perforation for making the individual bags is added.

The bags do not have to be made of two flat engaging plastic webs. It is possible to used a folded over flat web or a previously closed foil tube which is cut out at one end.

The production of the bags with value symbols or identifications still works when to apply the value symbol the one edge of the foil layer has a part folded outward and the value symbol is then applied after which the folded out end is again folded back in. The perforation for the hand hole is made. The further manufacture of the bag takes place without changes.

It is to be understood that the invention is not only limited to the illustrated embodiment, but changes are permissible within the scope of the claims. Thus the term bag covers sacks, pockets, and the like. In addition the draw strips can be initially formed of a wider material strip that is folded over to the desired width and laid into the head region of the bag.

I claim:

1. A bag comprising:

coextensive front and back walls each formed by a pair of separate thermoplastic foils;

side seams joining together the foils along side edges of the foils;

respective front and back longitudinal seams extending between the side seams and each bonding end edges of the foils of the respective front and back walls together, the front and back walls forming between the side seams at the longitudinal seams a fill opening extending over an entire width of the walls, each wall being formed at the fill opening with a hand hole that is narrower at the fill, opening than remote therefrom; and a draw strip between the foils of each wall, exposed at the hand hole, and anchored in the side seams.

2. The bag defined in claim 1 wherein the foils of each wall are different.

3. The bag defined in claim 2 wherein one of the foils of each wall is thicker than the other foil of the respective wall.

4. The bag defined in claim 2 wherein one of the foils of each wall is of a different thermoplastic than the other foil of the respective wall.

5. The bag defined in claim 1 wherein the hand hole is generally circular and is centered on the draw strip.

6. The bag defined in claim 5 wherein the hand hole has a radius generally corresponding to a width of the draw strip.

7. The bag defined in claim 1 wherein the hand hole is spaced by a web from the fill opening and the web is formed wit ha row of perforations extending between the hand hole and the opening.

8. The bag defined in claim 1 wherein the hand hole is defined by an annular perforation, whereby pieces of the foils can be removed at the hand hole for access to the draw strip.

9. The bag defined in claim 8, further comprising a tag secured to the pieces at the hand hole.

10. A method of making the bag defined in claim 1, the method comprising the steps of:

superposing two thermoplastic foils together with their edges coextensive;

welding together the superposed foils along end edges at a longitudinal seam;

punching a hand hole through the foils adjacent the longitudinal seam;

inserting a draw strip between the foils at the longitudinal seam;

folding the superposed foils into a U-shape; and welding together side edges of the foils to anchor the draw strap in the foils and form a bag having a fill opening at the longitudinal edge.

* * * * *